US005353504A

United States Patent [19]

Pai

[11] Patent Number: 5,353,504

[45] Date of Patent: Oct. 11, 1994

[54] MOTORIZED SCISSORS

[76] Inventor: Chung-Jen Pai, No. 309, Lien Cheng Rd., Chung Ho City, Taipei Hsien, Taiwan

[21] Appl. No.: 55,186

[22] Filed: Apr. 30, 1993

[51] Int. Cl.[5] ..... B26B 15/00

[52] U.S. Cl. ..... 30/228; 30/194

[58] Field of Search ..... 30/228, 226, 227, 241, 30/244, 245, 249

[56] References Cited

U.S. PATENT DOCUMENTS

| | | | |
|---|---|---|---|
| 3,143,801 | 8/1964 | Dancygier | 30/228 |
| 3,262,201 | 7/1966 | Docken | 30/228 |
| 3,365,963 | 1/1968 | Happe | 30/228 |
| 3,631,596 | 1/1972 | Glaus | 30/228 |
| 3,676,928 | 7/1972 | Herr et al. | 30/228 |

FOREIGN PATENT DOCUMENTS

| | | | |
|---|---|---|---|
| 328508 | 5/1930 | United Kingdom | 30/228 |

*Primary Examiner*—Richard K. Seidel
*Assistant Examiner*—Hwei-Siu Payer
*Attorney, Agent, or Firm*—Bucknam and Archer

[57] ABSTRACT

A motorized scissors includes a bottom casing to hold a first cutter blade and a motor and a battery power supply, a top casing covered on the bottom casing, a movable cutter holder to hold a second cutter blade, a looped handle pivoted to the top and bottom casings, and a looped switching lever controlled to connect or disconnect the battery power supply to the motor, the motor having an eccentric rotor disposed in an oval hole on the movable cutter holder and driven by the motor to impart a reciprocating movement to the movable cutter holder so as to open and close the first and second cutter blades.

1 Claim, 3 Drawing Sheets

MOTORIZED SCISSORS

BACKGROUND OF THE INVENTION

The present invention relates to scissors, and more particularly to motorized scissors.

Various scissors are manufactured, and widely used for cutting different materials. A normal scissors generally comprises two opposing blades, each having a looped handle, which are pivoted together in the middle so that they work against each other as it is closed on the paper, cloth, etc. to be cut. The performance of a scissors is determined according to the sharpness of the blades and smoothness of the scissors action, and the cutting speed of a scissors is determined according to the length of the blades and the frequency of opening and closing the blades. There are also described electrical scissors specifically designed for industrial use, which cut materials automatically at a high speed. However, these electrical scissors are designed for vertical cutting only. Further, operating these electrical scissors is not easy. One must be properly trained before using these electrical scissors.

SUMMARY OF THE INVENTION

The present invention provides motorized scissors which are easy to use and suitable for home use. The scissors comprise a looped switching lever to control the operation of a motor by pulling the looped switching lever backwards and then depressing it. As the motor is turned on, an eccentric rotor on the output shaft of the motor imparts a reciprocating movement to a movable cutter holder, and therefore the two opposing cutter blades of the scissors are closed and opened to cut the paper, cloth, etc. to be cut.

DETAILED DESCRIPTION OF THE PREFERRED EMBODIMENT

Figure 1:
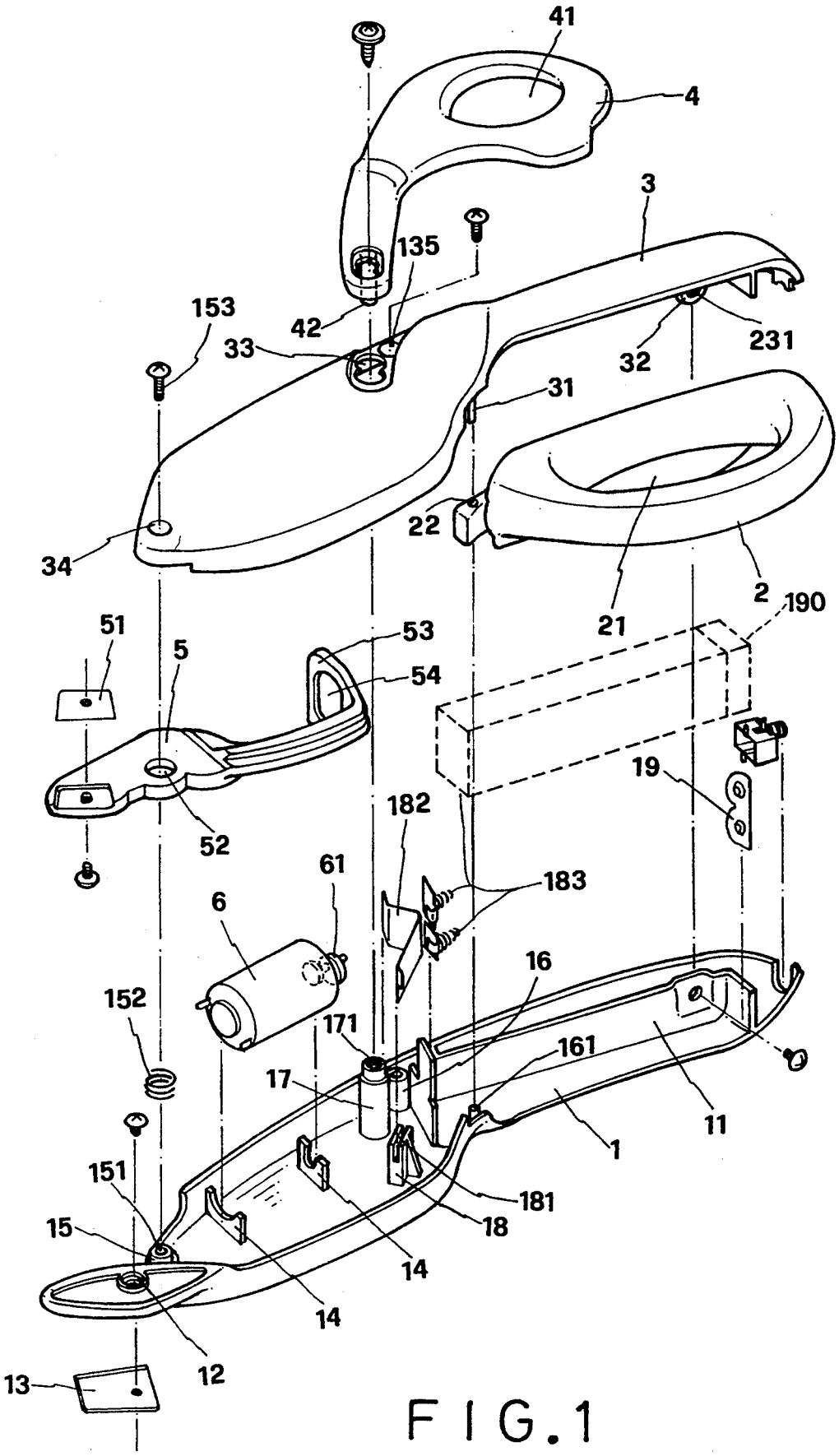
FIG. 1 is a perspective exploded view of a motorized pair of scissors according to the preferred embodiment of the present invention.

Referring to the annexed drawings in detail, a motorized scissors in accordance with the present invention is generally comprised of a bottom casing 1, a looped handle 2, a top casing 3, a looped switching lever 4, a movable cutter holder 5, and a motor 6.

The bottom casing 1 is integrally molded and made in an elongated, curved configuration having a battery chamber 11 at a rear end thereof on the inside for holding a battery, a cutter blade 13 fixed to a hole 12 on the outside at a front end thereof by a screw (not shown), two motor supports 14 spaced behind the hole 12 for supporting the motor 6, a stub rod 15 with a screw hole 151 disposed on the interior near the hole 12 for fastening the movable cutter holder 5 and the top casing 3 by a screw 153, a coil spring 152 mounted around the stub rod 15, a top pin 161 and an internally threaded top column 16 bilaterally disposed on the interior in the middle for fastening the top casing 3, a post 17 with a top screw hole 171 disposed between the motor supports 14 and the column 16 for pivotally fastening the looped switching lever 4, a protruded block 18 with a top groove 181 disposed between the motor supports 14 and the top pin 161, two opposite battery power supply contacts 183 respectively connected to the two opposite terminals of the battery 190 shown in phantom in the battery chamber 11 through the motor 6, a V-shaped contact metal spring 182 fastened in the top groove 181 on the protruded block 18 and controlled by the looped switching lever 4 to make a contact with the battery power supply contacts 183 in connecting the circuit, a battery connector 19 and a transformer at the rear end thereof connected to the battery in the battery chamber 11.

The looped handle 2 is integrally shape molded, having a finger hole 21 in the middle for inserting the fingers, and a pin hole 22 through a front end thereof into which the top pin 161 on the bottom casing 1 fits from the bottom. Therefore, the looped handle 2 can be pivoted on the top pin 161 to close or open the battery chamber 11.

The top casing 3 is integrally shape molded and fitted over the bottom casing 1 at the top, having a bottom pin 31 in the middle fitted into the pin hole 22 on the looped handle 2 from the top, a small bottom block 32 with a through hole 231 near a rear end thereof in the horizontal direction fixed to a respective screw hole on the bottom casing 1 by a screw (not shown), a lever mounting hole 33 formed of two linked round holes at a location corresponding to the top screw hole 171 on the post 17 of the bottom casing 1, which receives a hollow bottom pivot 42 on the looped switching lever 4, a front through hole 34 near a front end thereof at a location corresponding to the screw hole 151 on the stub rod 15 of the bottom casing 1, through which a screw 153 is inserted into a through hole 52 on the movable cutter holder 5 and then threaded into the screw hole 151 on the stub rod 15 to couple the top casing 3, the movable cutter holder 5, and the bottom casing 1 together, and a middle through hole 135 near the lever mounting hole 33, through which a screw is threaded into the internally threaded top column 16 to fix the top casing 3 to the bottom casing 1.

The looped switching lever has a hollow downward pivot 42 on a front end thereof inserted through the lever mounting hole 33 on the top casing and connected to the top screw hole 171 on the post 17 by a screw, and a finger hole 41 on a rear end thereof for inserting the fingers.

The movable cutter holder 5 is integrally shape molded, having a front end fixed with a cutter blade 51 opposing the cutter blade 13 on the front end of the bottom casing 1 for cutting, a through hole 52 in the middle, through which the screw 153 inserts, a rear end terminated to a looped handle 53 with an oval hole 54, which receives an eccentric rotor 61.

The motor 6 has an eccentric rotor 61 coupled to the output shaft thereof. Because the eccentric rotor 61 is disposed in the oval hole 54 on the looped handle 53 of the movable cutter holder 5, it imparts a reciprocating motion to the movable cutter holder 5 as the motor 6 is turned on.

Figure 2:
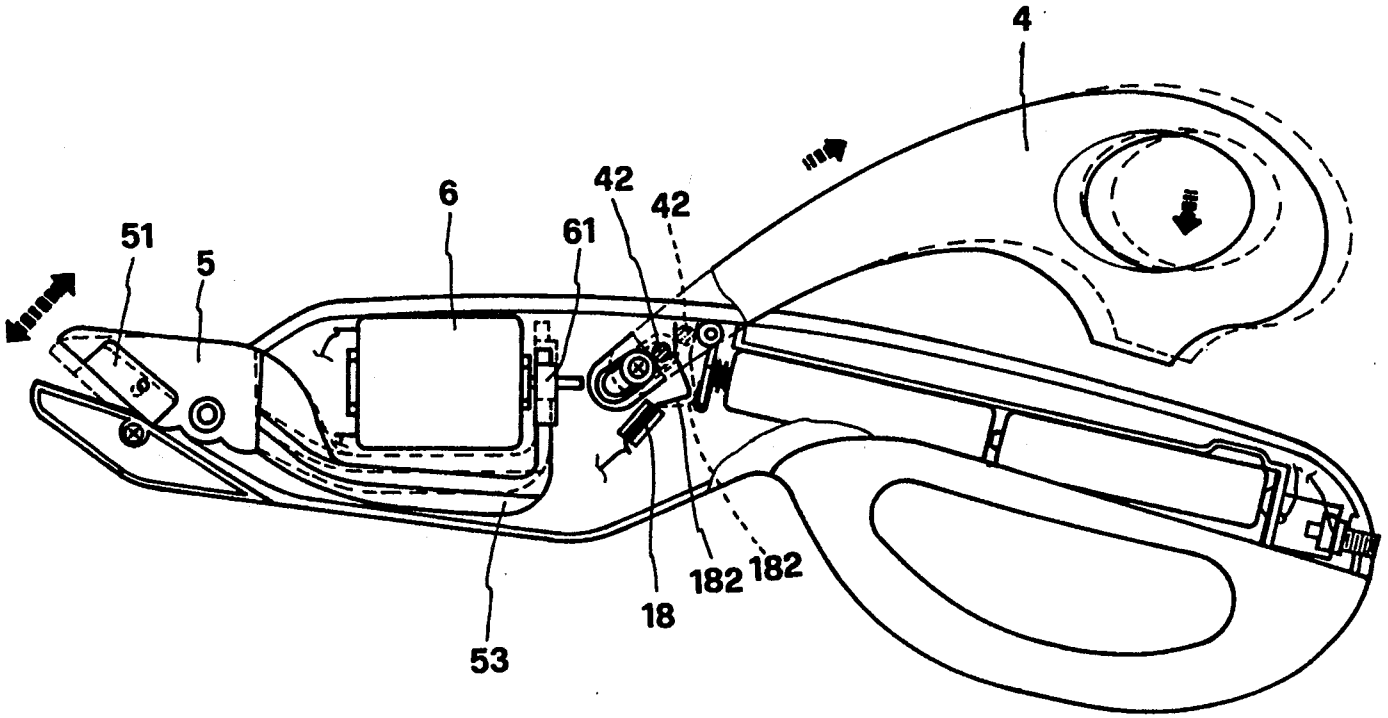
FIG. 2 is a plan view of the motorized scissors showing its scissors action.
Figure 3:
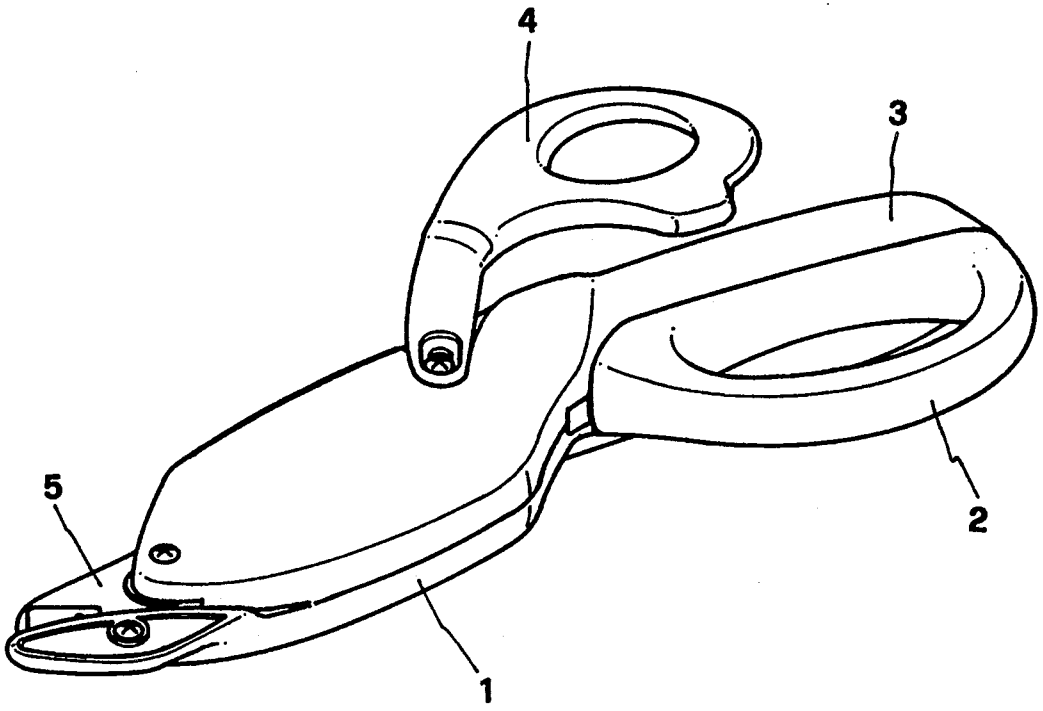
FIG. 3 is an elevational view of the motorized scissors.

Referring to FIG. 2, the contact metal spring 182 is electrically connected to the battery power contacts 183 to turn on the motor 6 by pulling the looped switching lever 4 backwards and then depressing it. As the motor 6 is turned on, the eccentric rotor 61 is rotated within the oval hole 54, causing the movable cutter holder 5 to oscillate on the screw 153, and therefore a scissors action is continuously performed between the cutter blades 13;51. The contact metal spring 182 will immediately return to its former shape and disconnect from the battery power contacts 183 to cut off the power supply from the motor 6 as the downward pressure is released from the looped switching lever 4. When not in use, the looped switch lever 4 is pushed back to its former position. Because the looped switching lever 4 serves as a safety switch which controls the operation of the motor 6, the motor 6 will not be triggered when the scissors are played by a child. The scissors are specifically designed for tailoring. The maximum cutting thickness of the scissors is about the combined thickness of two pieces of jean. The effective cutting area is defined between the cutter blades 51;13. Further, the cutter blades 51,13 each has a front end respectively curved outwards. This arrangement effectively prevents the children from inserting the fingers in between the cutter blades 51;13.

While only one embodiment of the present invention has been shown and described, it will be understood that various modifications and changes could be made without departing from the spirit and scope of the invention.

What is claimed is:

1. A motorized scissors comprising:

a bottom casing having an interior, an exterior, a middle portion, a bottom, a rear end, a top and a front end, a battery chamber at said rear end thereof, said chamber having an interior for holding a battery, said battery having two terminals, a cutter blade fixed to a cutter blade mounting hole on said exterior of said casing at a front end thereof by a screw, two motor supports spaced behind said cutter blade mounting hole, a stub rod with a screw hole disposed on said interior of said chamber near said cutter blade mounting hole, a coil spring mounted around said stub rod, a top pin and an internally threaded top column bilaterally disposed on said interior of said chamber in said middle portion of said casing, a post with a top screw hole disposed between said motor supports and said internally threaded top column, a protruded block with a top groove disposed between said motor supports and said top pin, two opposite battery power supply contacts respectively connected to said two terminals of said battery being received in said battery chamber, a V-shaped contact metal spring fastened in said top groove on said protruded block and controlled to make a contact with said battery power supply contacts;

a looped handle having a pin hole on one end thereof, said top pin on said bottom casing fitting within said pin hole from said bottom of said casing for allowing said looped handle to be pivoted thereon;

a top casing having a top, a front end and a rear end and fitting over said bottom casing at said top of said bottom casing, said top casing having a bottom pin fitted into said pin hole of said looped handle from said top of said bottom casing, a small bottom block with a through hole near said rear end of said top casing fixed to a screw hole on said bottom casing by a screw, a lever mounting hole formed of two linked round holes and disposed above said top screw hole on said post of said bottom casing, a front through hole near said front end of said top casing disposed above said screw hole on said stub rod of said bottom casing;

a looped switching lever having a front end and a rear end and having a hollow downward pivot on said front end thereof inserted through said lever mounting hole on said top casing and connected to said top screw hole on said post of said bottom casing by a screw, and a finger hole on said rear end thereof for inserting fingers;

a movable cutter holder having a front end, a middle portion and a curved rear end and pivotably connected between said top casing and said bottom casing, said movable cutter holder having said front end fixed with a cutter blade opposing to the cutter blade on said bottom casing for cutting, a pivot hole in said middle portion pivotably connected to said screw hole on said stub rod of said bottom casing, and an oval hole on said curved rear end thereof; and a motor having an eccentric rotor coupled to an output shaft thereof and disposed in said oval hole on said movable cutter holder;

whereby said eccentric rotor imparts a reciprocating movement to said movable cutter holder, as said looped switching lever is pulled backwards and depressed to connect said contact metal spring and said battery power supply contacts in turning on said motor, said motor is turned on, causing the cutter blades to close and open.

* * * * *